United States Patent [19]

Yazawa et al.

[11] 4,052,243

[45] Oct. 4, 1977

[54] METHOD FOR PRODUCING A CROSS-LAMINATED CLOTH-LIKE PRODUCT FROM WIDE WARP AND WEFT WEBS

[75] Inventors: Masahide Yazawa; Haruhisa Tani; Masaki Matsumoto; Yasuo Sasaki, all of Tokyo, Japan

[73] Assignees: Polymer Processing Research Institute Ltd., Tokyo; Sekisui Kagaku Kogyo Kabushiki Kaisha, Osaka, both of Japan

[21] Appl. No.: 709,045

[22] Filed: July 27, 1976

Related U.S. Application Data

[63] Continuation-in-part of Ser. No. 651,106, Jan. 21, 1976.

[30] Foreign Application Priority Data

Apr. 5, 1976 Japan ..... 51-38413
Jan. 28, 1975 Japan ..... 50-11653

[51] Int. Cl.[2] ..... B32B 31/00

[52] U.S. Cl. ..... 156/265; 128/100; 156/266

[58] Field of Search ..... 156/176, 178, 177, 181, 156/264, 519, 517, 302, 301, 297, 299, 304, 265, 266; 28/1 CL

[56] References Cited

U.S. PATENT DOCUMENTS

| | | | |
|---|---|---|---|
| 3,250,655 | 5/1966 | Adler | 156/181 |
| 3,669,795 | 6/1972 | Yazawa et al. | 156/265 |
| 3,765,989 | 6/1972 | Burger | 156/265 |
| 3,853,662 | 12/1974 | Yazawa et al. | 156/265 |
| 3,859,156 | 1/1975 | Yazawa et al. | 156/265 |

*Primary Examiner*—Charles E. Van Horn
*Assistant Examiner*—Michael W. Ball
*Attorney, Agent, or Firm*—Fred Philpitt

[57] ABSTRACT

An improved method for effecting cross-lamination of wide warp and weft webs is provided, wherein a continuous row of cut weft webs having a length corresponding to the width of the warp web to be cross-laminated thereto and arranged in side by side relationship is temporarily prepared on a warp material which is (1) a belt means from which said row of weft webs is transferred onto a warp web in order to be fixed thereto for effecting cross-lamination, (2) a warp web backed up by a belt means from which said row is peeled off in the state loaded on the warp web in order to be fixed thereto for effecting cross-lamination, or (3) a warp web itself to which said row is fixed for effecting cross-lamination, so that the warp material travelling crosswise over the cut weft web at a vertical distance apart therefrom and having been wetted with a liquid having adhesion property to the surface thereof facing said cut weft webs is subjected to successive reciprocating vertical motions so as to touch and pick up the cut weft webs one by one by temporary adhesion to the warp material arranged in side by side relationship, due to the adhesion property of said liquid wetting the surface of the warp material.

4 Claims, 3 Drawing Figures

METHOD FOR PRODUCING A CROSS-LAMINATED CLOTH-LIKE PRODUCT FROM WIDE WARP AND WEFT WEBS

CROSS REFERENCE TO RELATED APPLICATION

The present application is a Continuation in Parts application of Application Ser. No. 651,106 filed on Jan. 21, 1976 in U.S.

BACKGROUND OF THE INVENTION

The present invention relates to a method for producing laminated cloth-like products of wrap and weft webs having each a large width and having optional combinations of fiber density in warp and wefts. Further it relates to an improvement in the method of the prior invention made by the present inventors (U.S. Pat. No. 3,859,156).

In the above-mentioned prior invention, cut weft webs are adhered successively one by one onto the upper surface of a circulating lattice conveyer and then advanced to the lower side surface thereof where they are pushed downward one by one by reciprocating action of a number of linear edges thrusted out from and drawn back into between the lattice members of said conveyer so as to fly the cut weft web toward a warp web running crosswise below.

However, in the practice of said method, it has been found that this method has the following drawbacks:

A drawback lies in that the weft webs loaded on the upper surface of the circulating conveyer must be turned around the turning point and conveyed to the position to be pushed down as stated above, and hence, if the web is stiff, thick or of a high density, as in case of the web of glass fiber yarns or robings, or a thick organic fiber web, the web is apt to drop spontaneously off the conveyer, while going too far beyond the turning point due to difficulty in turning around said turning point, unless the turning curvature thereof is sufficiently large.

Another drawback lies in that if a weft web is heavy in weight per unit area, or the web is composed of a comparatively small number of yarns and insufficient in the contact area for adhering to the surface of the conveyer, the web is apt to drop spontaneously off said surface on the lower side circulation route thereof even when the web may turn around said turning point. Accordingly in these cases, the surface area of the conveyer to which the web is adhered, should be increased as much as possible.

Once thus said surface is increased, however, a further trouble may occur in that if the web having a large contact area is to be cross-laminated, the web is difficult to be peeled off from said increased surface when pushed downwards. This fact teaches that the surface area of the conveyer should be changed as the contact area of the web to be cross-laminated changes.

A further drawback lies in that as linear edges for pushing the cut weft web downwards are drawn back halfway, they do not hit the surface of the warp web in the abovementioned mentioned prior invention. Accordingly, the web is apt to be subjected to occasional disorderly overlaying, due to disturbance of the surrounding air while flying downwards and moreover subjected to fluctuation in overlaid position on the warp web, especially when the cross-lamination speed is changed, say at the time of starting.

The above-mentioned drawbacks are several examples of those as seen in the cross-lamination operation. However, even in the case of the method of the above-mentioned prior invention, if the tops of said linear edges are so thrusted out as to hit in a moment the surface of the warp web, at least, the drawback mentioned just above is avoided, and uniformly cross-laminated product may be obtained.

Thereafter an improved method over the prior invention has been found and filed on Jan. 21, 1976 as U.S. Ser. No. 651,106 (parent application of the present C.I.P. application), entitled "method for producing a product comprising weft webs of a large width continued in the warp direction," wherein cut webs for wefts were successively connected in the warp direction by selvedges adhered onto both the margins of the cut weft webs. The product can be made into a cross-laminated product by merely laminating with a warp web in case of necessity.

Said method comprises circulating two right and left heated belts having thereon a hot melt type adhesive in a tacky state and spaced by the length of each of cut webs for wefts; adhering onto each of the belt, selvedge material to constitute the selvedges of final product; suddenly dropping the two belts having the selvedges adhered thereto, respectively, on the lower circulating route of the belts, down onto one of cut weft webs loaded successively and at a given gap on a conveyer circulating below the belts and perpendicularily thereto, over the length corresponding to the width of the webs for wefts, when both the ends of one of the cut weft webs and corresponding belts overlapped each other, thereby to adhere both the ends of the cut weft web onto the corresponding belts having selvedge materials thereon and said adhesive on the lower surfaces, and just thereafter suddenly elevating the belts thereby to strip and hang up the cut weft web adhered onto the belts from the conveyer; repeating the above-mentioned procedure; and peeling the resulting belts having successive cut weft webs adhered thereon without leaving any gaps therebetween and selvedge materials also adhered thereto from the belts.

The method further comprises circulating a plurality of belts provided between said belts above-mentioned, and providing a plurality of yarns on said plurality of circulating belts in advance.

In the course of further researches, it has become clear that, in place of said hot melt type adhesive, a liquid having adhesion property can be used for picking up cut weft webs while adhering onto the belts, and at the same time, said selvedge materials are not always necessary, since transferring of the continued cut weft webs adhering to the circulating belts has been found to be possible even without providing selvedge materials onto a warp web, which is most simply a set of two selvedge materials of the improved invention, and further, belts or a plurality of belts for picking up cut weft webs, in some cases, can be replaced by the warp web itself. Thus the method of the present invention is provided.

Although the method described above, wherein weft webs are moved onto the warp web to be overlaid without flying in the air between the two is an improved method over the prior invention, the method of the present invention wherein a warp material comprising a warp web, a belt means circulating in the warp direction and a combination of said belt means with a warp web moves towards the weft webs to touch and pick up them one by one, is quite different from the prior invention. Thus the present invention can be said as a kind of improved method of the previous one.

SUMMARY OF THE INVENTION

The present invention provides a method for producing a cross-laminated cloth-like product from a wide warp and wide weft webs composed of fibers, filaments, or yarns of organic or inorganic origins.

The method lies in that in the method for forming a crosswise laminated structure of a wide warp and wide weft webs without leaving any gaps between each of the weft webs in the production of the cross-laminated cloth-like product, where a warp web is continuously fed to travel in the warp direction of the product to be prepared, and wefts webs cut to a length corresponding to the width of the product to be prepared, are fed horizontally one by one along the line crosswise to that of production of the product and after cross-overlaid, the resulting structure of warp and wefts is fixed by a binder, temporary forming of a continuous row of cut weft webs arranged in side by side relationship is effected before fixing of said structure according to the following method:

A method which comprises:

causing a warp material to travel along the line of production of product, while intersecting the feeding line of cut weft webs carried on a conveyer and travelling horizontally and crosswise thereto and vertically apart therefrom, said warp material being wetted on the surface thereof supposed to receive the cut weft webs, with a liquid having adhesion property and having a sufficient width for covering the width of the warp web and a sufficient effective surface area for picking up the whole part of one of the cut weft webs in the flat state, when wetted with said liquid;

at each time when one of the cut weft webs comes to the position wholly overlapped with the travelling warp material, subjecting at least the part of the warp material facing the one of the cut weft webs to a sudden reciprocating vertical motion so as to touch and pick up the cut weft web by temporary adhesion to the warp material due to the action of said liquid having adhesion property; and repeating the above-mentioned reciprocating motions of the warp material successively, whenever the warp material advances by the distance corresponding to the width of the cut weft web at a speed so controlled that the cut weft webs are picked up one by one in a row without leaving any gaps between each other, and thereby effecting temporary forming of a continuous row of cut weft webs arranged in side by side relationship on the warp material.

And thus temporarily formed continuous row of cut weft webs is fixed onto a warp web.

Detailed Description of the Invention

The warp material referred to herein means (1) a belt means from which said row of weft webs is transferred onto a warp web in order to be fixed thereto for effecting cross-lamination, (2) a warp web backed up by a belt means from which said row is peeled off in the state carried on the warp web in order to be fixed thereto for effecting cross-lamination, or (3) a warp web itself to which said row is fixed for effecting cross-lamination. In case the warp material is a belt means itself, said row of cut weft webs is transferred from the warp material onto a warp web onto which said row of cut weft webs is to be fixed; in case the warp material is a warp web picked up by a belt means, the warp web with temporarily formed continuous row of cut weft webs overlaid thereon is peeled off from the belt means and mutual fixation of both the webs is effected; and in case the warp material is a warp web itself, the temporarily formed continuous row of the cut weft webs overlaid on said warp web is fixed to said warp web.

Difference between the two methods of the present invention and the prior one referred to hereinbefore are as follows:

According to the method of the prior invention, each one of the weft webs is pushed off from the conveying means thereof and made to fly in the air till it arrives on the warp web for effecting cross-lamination, whereas, according to the method of the present invention, a travelling warp material repeatedly moves vertically towards a weft web, till the warp material touches the weft web to peel off and pick up the web from the conveying means therefor, and as mentioned above, there is a case where the warp material is a warp web itself; another case where it is a circulating belt means alone; and a further case where it is a combination of a warp web and a circulating belt means for backing up the web, in accordance with the nature of the warp web or others. In case where the warp material is a belt means alone, it is necessary to transfer the weft webs picked up on the belt means, onto a warp web to effect cross-lamination.

Wide webs usable for warp and weft webs in the present invention are as follows:

1. A wide uniaxially oriented film, a split fiber web of reticulated structure prepared by spitting said oriented film and a laterally spread web thereof.
2. A warped web of individually independent yarns, comprising spun yarns, filament yarns, stretched tapes (fiber yarns, ribbon yarns or flat yarns) and split yarns prepared therefrom, monofilament yarns, glass fiber yarns, glass fiber robings and carbon fiber yarns, etc., which web is taken out by warping directly from bobbins on creels, taken out from a beam or beams on which warped yarns are wound, or taken out from a roll of a web composed of yarns arranged at wide pitches of 5 – 10 mm and wound up on a straight core bobbin, the arrangement of which yarns is fixed by a number of filaments of a adhesive polymer, centrifugally ejected and laterally connecting the yarns one after another by adhesion thereto, prepared according to the method invented by the present inventors (Japanese publication No. 9067/1976 published on Mar. 23, 1976) (corresponding application: U.S. Ser. No. 527,920 filed on Nov. 29, 1974).
3. A web of widely spread filament tow into uniform thickness or the same, the fiber arrangement of which is additionally fixed by gluing, a widely spread web of filaments, the fiber arrangement of which web is fixed by gluing just after drawing followed by heat setting of flatly arranged raw material, for example, non-drawn melt spun filaments, while maintaining the arranged width thereof intact.

Said gluing is effected is several ways, i.e., if the fiber density of the web is more than 20 gr. per square meter, the arrangement of the fibers in the web can be fixed by spraying glue so as to form a reticular glue membrane thereon, but, especially in case the fiber density of the web is as thin as 10 - 15 gr. per square meter, a way to attain so stable a fixation of the fiber arrangement as to be capable of flatly winding upon a straight core bobbin is that the web is laminated with a gluing web composed of warps of parallel yarns of a thin denier arranged at widely spaced intervals and wefts of a number of filaments of an adhesive polymer centrifugally ejected so as to laterally connect the warp yarns, prepared according to the above-mentioned method, so as to be wound up stably until the wound up diameter becomes larger.

4. An oriented wide web of short fibers prepared by drafting a number of slivers prepared from filament tows by Perlok system and having an average fiber length of 150 - 300 mm or more, or obtained by means of ordinary carding machine, till the web comes to have a predetermined fiber density, while arranged flat in a wide width and fixed in the fiber arrangement thereof by gluing on one surface thereof or laminated with a gluing web explained above.

5. A web prepared by spreading a filament tow thinly and uniformly, turning the continuous fibers thereof into short fibers by Perlok system or others and drafting till the web comes to have a predetermined fiber density, and a web emerging from a carding machine, the fiber arrangement of each of which web is fixed by lamination with a gluing web explained above, or by gluing on one surface thereof by kiss roller method or spraying method followed by drying.

In the present invention, for each of the warp and weft webs, there are cases where webs of the same kind and the same density as well as of different kind and different density can be used, respectively.

Next, said warp material for picking up weft webs in the present invention will be further mentioned below.

As mentioned above, in the method of the present invention, there is a case where a warp web itself, which has a sufficiently wide effective adhering surface area for picking up cut weft webs stably when wetted with a liquid having adhesion property, for instance, a wide web composed of densely arranged filaments or a number of parallel yarns or flat yarns (stretched tapes), is used as a warp material.

There is, however, another case where a certain warp web is difficult to pick up weft webs stably even when wetted as above, due to a very small effective adhering surface area, as in the case of a web having small fiber density, that is, a web of yarns arranged at 10 - 20 mm pitches. In this case the adhering surface area should be made up by other means, say a belt means, which has a sufficient surface area. Thus there is a case where the warp material is a warp web backed up by a belt means to increase said surface area.

Further there is a case where a belt means itself is used as a warp material.

As for belt means usable for a warp material, a circulating wide single belt may be used, but, because of troubles in case of using such a wide single belt, such as easy creasing, meandering or difficulty in expelling the surrounding atmospheric air at the time of picking up weft webs, it is preferable to use a circulating belt means composed of a number of parallel running belts of tape or cord shape, or belts of 30 - 50 mm in width running in parallel at 150 - 300 mm pitches.

In applying such belt means, it is also preferable to arrange the belts so as to circulate in such a manner that on the inlet side of the picking up zone, the belts are arranged so as to run at a definite pitches, but at the outlet thereof, after picking up followed by peeling off of the weft webs, the belts are arranged so as to run at somewhat wider pitches, using a suitable guide means. According to said method, slackening of the weft webs which is apt to occur when the web is picked up by the belts, can be straightened due to tenter-like action of the belt means, resulting in obtaining uniformly regular warp and weft structure.

Moreover, in case a warp web itself is used as a warp material, it is preparable to use backing up belts on both right and left selvedge parts of the warp web while being adhered thereto, and to guide said belt divergently while being in the wetted state as stated above, in order to prevent the picked up weft webs from creasing and slackening.

As for belts suitable for use in the method of the present invention, belts made of an elastomer or those containing a cord fabric therein are preferable.

In the present invention, in case of using webs of high fiber density, it is preferable to use a belt means having a suitable surface area for picking up, in a stable way, cut weft webs to be transferred onto a warp web from said belt means, because of a comparatively small area to be wetted, which results in such a merit that the quantity of liquid necessary to be dried up becomes smaller.

And in case a warp web is fed while being backed up by a number of belts, it is necessary to take care of wetting only the parts of the warp web which directly touch said backing up belts, on the back sides.

Said liquid having adhesion property for wetting the surface of the warp material will be explained below.

As for said liquid, water 0.01 - 0.2% aqueous solution of high molecular weight polyethylene oxide, aqueous solution of PVA, or various kinds of gluing agents available from market, an aqueous emulsion of adhesive polymer, or molten hot melt type adhesive polymer blend, etc. can be employed.

However, in case a hot melt type adhesive polymer blend is used as said liquid for a belt means, it is necessary to bear in mind that the belts of said belt means must be kept hot while being circulated, say at 70° - 90° C. Otherwise, the hot melt type adhesive polymer blend loses adhesive tackiness due to solidification.

As for the liquid having adhesion property, however, it is preferable to use a liquid which does not contaminate or stain the belts or their guide means, etc. so that, in general, it is preferable to use water or an aqueous solution of an agent which gives viscous liquid, even when a very small amount of it is used.

Next, adhesive polymers for fixing the warp and weft structure of the product of the present invention will be explained hereinafter. Said polymers can be fed in several ways.

In one way, the adhesive polymer of a hot melt type is fed in advance in a state of a number of filaments adhering to the raw web for cross-lamination according to the prior method of the present inventors referred to hereinbefore, and in another way, the adhesive polymer is also of a hot melt type and applied to the raw web in advance by kiss roller method.

In a further way, said adhesive polymer is fed onto the web or webs on the cross-lamination apparatus, just before cross-overlaying or after cross-overlaying, in a suitable form, say as a solution, an emulsion or a hot melt form.

A hot melt type adhesive blend has a merit in solidifying in a very short time, but on the other hand, a demerit in having relatively low heat-resistance. As for heat resistant adhesion, P.V.A. or its blend or adhesives of thermosetting nature or those settable by other means are frequently applied.

Next, the relative position of travelling warp and weft webs will be explained below, as compared with the method of prior invention referred to hereinbefore.

According to the method, cut weft webs are transferred, while flying in the air, down onto the warp web travelling crosswise below a conveyer conveying said weft webs, so as to overlap one by one with the warp web. Contrary to the above-mentioned, however, according to the method of the present invention, travelling warp material moves vertically till the warp material touches the surface of the conveyer to pick up the weft web conveyed thereon.

In both the method, it is possible in principle to cross-overlay the weft web on the warp web whether the warp web or warp material is made to travel crosswise above or below the conveyer conveying the cut weft webs horizontally.

In the method of the present invention, however, it is preferable to make the warp material travel across above the conveyer for reasons mentioned below.

In case where the warp material travels across above the conveyer, the cut weft webs are supported only by the lattices of the conveyer from below while being loaded on the upper surface of said conveyer, and there is no problem, say of dropping off, even when the contact area of the webs with said surface is made so small as to be easily peeled off from said surface in said cross-overlaying.

According to the method of the present invention, however, to ensure stable picking up of the weft web by a warp material and following cross-lamination, the warp material should have a sufficiently wide adhering area to said weft webs when wetted with a liquid having adhesion property, that is to say, in case where the warp material is a warp web having a small adhering area, because of widely open structure thereof for said warp web, the necessary contact area for effecting sure and stable adhesion should be made up by a backing up circulating belt means which is to be peeled off from the warp web after cross-overlaying of the weft webs, or should be replaced by a circulating belt means alone, having a sufficient contact area, from which belt means the weft webs, after picked up one by one, are transferred onto a warp web to form warp and weft structure.

As a circulating conveyer for conveying the cut weft webs, it is preferable to use a lattice conveyer composed of a number of parallel angle bars as lattice members, each one of which is fixed at the right and left ends thereof to the respective side chain links circulating in parallel while keeping a definite distance apart from each other, in a state where one side of each of said angle bar members protrudes upright from the surface of the circulating route of the conveyer for loading the weft webs on the top lines of the angle bars, on the upper circulation route thereof.

By way of said means, the contact area of the weft web with the circulating conveyer can be kept as small as possible to meet the requirement for picking up the weft webs surely and stably from the surface of the conveyer. At this time, it is necessary to keep the weft web wet, for such reasons that the troubles caused by electrostatic charge on the organic or inorganic fiber base webs, can be avoided, that the webs of organic fiber base, when melt-cut by red heated cutter, is prevented from burning and also that the web can be stably adhered to the surface of the conveyer due to the surface tension of said wetting water.

Conveyers applicable to the method of the present invention are not necessarily limited to those mentioned above, but may be those of other forms which can attain the same functions as mentioned above.

There are several ways for loading cut weft webs one by one at definite intervals on said conveyer. Among them, a preferable way is the one in which a continuous web for cut weft webs in a wetted state is fed through a pinching roller means at predetermined constant speed onto the conveyer also wetted with water on the surface thereof and circulating at a faster speed than the feeding speed of the web by a value calculated from the necessary spacing between each other, and the web is cut on said conveyer by a predetermined length one by one by a cutter descending from above, while being pulled by the speed difference between the web and the conveyer, whereby the cut weft webs for wefts proceed into the position one by one at the circulation speed of the conveyer, while keeping the predetermined spacing from the succeeding webs to be picked up by the warp material.

Generally, said spacing is sufficient for overlaying in the method of the present invention, when kept at several percents of the cut length of the web, and the shorter the time necessary for picking up the weft webs is, the narrower the spacing is.

The overall circulating length of said lattice conveyer should be an integer times the sum of the cut length of the weft web and said predetermined spacing.

As stated above, the cut weft webs are conveyed one by one with a predetermined spacing between each other, while being loaded on the conveyer by adhering to the upper surface thereof, and when one of the cut weft webs advances till the web comes to the position wholly overlapped with the warp web travelling crosswise over said conveyer at a vertical distance apart therefrom, at least the part of the warp material which is supposed to receive the cut weft web, is subjected to a sudden reciprocating vertical motion to touch and pick up the cut weft web by temporary adhesion to the warp material due to the action of said liquid having adhesion property, and the above-mentioned reciprocating motions are repeated whenever the warp material advances by the distance corresponding to the width of the cut weft web at a speed so controlled that the cut weft webs may be picked up one by one in a row without leaving any gaps between each other. This is the specific feature of the present invention.

The temporarily formed continuous row of cut weft webs thus obtained is fixed to a warp web. In case the warp material is a belt means, said row of cut weft webs is transferred from the warp material onto a warp web to which said row of cut weft webs is to be fixed; in case the warp material is a warp web backed up by a belt means, said row of cut weft webs carried on the warp web is peeled off from said belt means and fixed onto the warp web; and in case the warp material is a warp web itself, the row of the cut weft webs is fixed thereto.

By the method of the present invention, uniform regular warp and weft structure is obtained.

Next, the method of the present invention will be illustrated below referring to the accompanying drawings.

DETAILED DESCRIPTION OF THE PREFERRED EMBODIMENTS

Figure 1A:
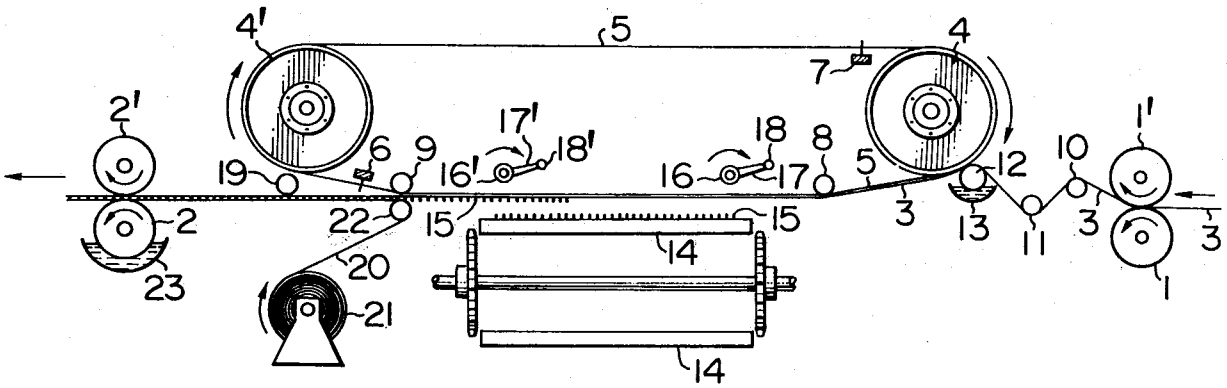
FIG. 1*a* is an elevation of the apparatus for cross-overlaying according to the present invention in a schematical manner.

FIG. 1*a* illustrates a preferred case concerning a first case where the warp material is a warp web itself, but a circulating belt, wetted with a liquid having adhesion property, is provided and made to travel along each of the selvedge parts of the warp web, while backing up the respective selvedge parts of the web so as to effect tentering action thereon.

A second case where a belt means is used as a warp material, can be illustrated conveniently by the same drawings as those of the method of the first case shown in FIG. 1*a*. In said second case, however, the position where the warp web is introduced is different from that shown in FIG. 1*a* and is shown in FIG. 1*c*. The warp web is introduced so as to receive the row of weft webs picked up on the warp material thereon, at the time of peeling off from said warp material.

Figure 1B:
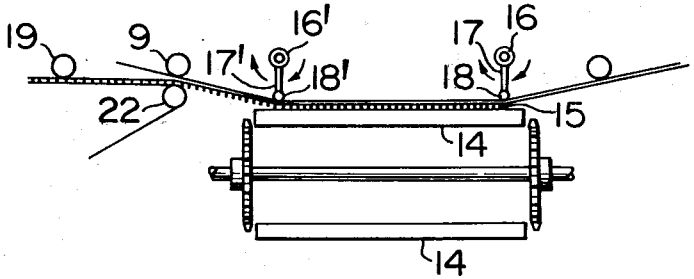
FIG. 1*b* shows the moment when the warp material is pushed down to touch the cut weft web for picking up.
Figure 1C:
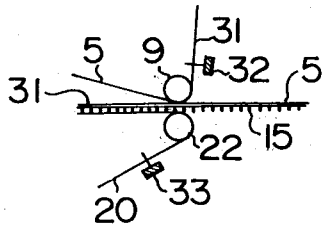
FIG. 1*c* shows the way of transferring cut weft webs picked up onto a warp web, when the belt means composed of a number of circulating belts is used as a warp material.

Thus, both the first and second cases will be illustrated referring to FIGS. 1*a*, 1*b* and 1*c*.

The first case will be at first explained referring to FIGS. 1*a* and 1*b*.

Warp web 3 introduced through pinching roller means 1, 1' and passed over dancing roller 10 and guide roller 11, is wetted with a liquid having adhesion property by kiss roller 12 half-immersed and rotating in vessel 13 containing said liquid therein, and made to travel horizontally between guide rollers 8 and 9 positioned apart from each other by a distance wider than that corresponding to the width of one weft web 15, while contacting with belts 5 on the lower side thereof along each of the right and left selvedges of warp web 3, respectively, which belts 5 are circulated around rotating drums or rollers 4 and 4' in a manner where the belts are so guided as to have a predetermined interval therebetween at the inlet of guide roller 8, but the belts are guided somewhat divergently by guide comb 6 before reaching roller 4', while the belts convergently recovers the original distance therebetween at comb 7 just before roller 4.

Lattice conveyer 14 circulating horizontally and in the weft direction (in many cases at right angle to the warp direction) is provided below the travelling warp web, as shown in FIGS. 1*a* and 1*b*. A web for wefts is fed continuously at a constant speed onto lattice conveyer 14, while being wetted with water, through a pinching roller means (not shown). As the circulating speed of the conveyer is made higher than the feeding speed of the web for wefts by a value calculated from the necessary spacings between each of cut weft webs mentioned below, the web is pulled by the conveyer, while adhering to the surface thereof, due to adhering action of the wetting water and friction between the two.

While keeping the state thus pulled on the conveyer, the web is cut into cut weft webs successively at every time when the web advances by the length corresponding to the width of the warp web, with a rapidly descending cutter (not shown) from above, and the resulting cut weft webs advance at the same speed as that of the conveyer, while leaving a given spacing from the succeeding cut weft web.

When the front and rear ends of cut weft web 15 come to meet with the respective right and left selvedges of warp web 3 so as to be wholly overlapped with each other, at least the portion of the warp web 3 covering the whole width of weft web 15, together with backing up belts 5 along both the selvedges of the warp web, is repeatedly pushed downwards in a reciprocating manner so as to contact with cut weft web 15, as shown in FIG. 1*b*, by pushing down rollers or bars 18, 18' coated with a shock-absorbing material and provided on rotating shafts 16, 16' through arms 17, 17', respectively.

Pushing rollers 18, 18' are rotated around shafts 16, 16' so that the rotating speed may reach its maximum when the rollers come to the point of touch with the warp web and the belts, by means of an eccentric gear means or a link mechanism on the driving means thereof (not shown), while keeping every one rotating time around the shaft constant.

Thus the warp web picks up the cut weft web by the action of the liquid having adhesion property, wetting the warp material and rapidly returns to the original travelling route, and at every time when the warp web together with the cut weft webs picked up thereon advance just by the distance corresponding to the width of the weft web at a speed so controlled that the succeeding cut weft web to be picked up just then may come to the position wholly overlapped with the warp web, as above-mentioned, said reciprocating motions of the warp web are repeated, whereby the cut weft webs adhere onto the lower side surface of the warp web in a row, without leaving any gaps between each of the weft webs.

The warp web together with the cut weft webs adhered thereto travel horizontally toward guide roller 9 and are guided there, while being somewhat spread laterally, due to the effect of the backing up belts guided by guide comb 6, along somewhat divergent course towards roller 4', and then the backing up belts are separated from said warp web at guide roller 9, whereby creasing and slackening which are apt to occur for some reasons in the course of cross-overlaying are eliminated to obtain a temporarily overlaid product of regular warp and weft structure.

The belt means separated at guide roller 9 from warp web 3 cross-overlaid with weft webs 15 is directed aslantly upwards toward roller 4', and warp web 3 together with weft webs thereon after passing over guide roller 9, are directed towards guide bar 19, in the direction different from that of the belt mean. The weft webs picked up on warp web 3 are again loaded, at guide roller 22 positioned near and below guide roller 9, on another warp web 20 drawn out from roll 21 through said guide roller 22 so as to be held between said web 20 and the warp web 3, lest the weft web should fall off from warp web 3. The whole is glued with an adhesive binder for fixing the arrangement of warp and weft structure thereof at pinching roller means 2, 2' having reservior 23 to which said adhesive binder is supplied, and then guided forward towards drying means, such as, heated cylinder or a hot chamber (not shown) for fixing said arrangement with said adhesive binder after drying. The product obtained consists of weft webs sandwiched between two upper and lower side warp webs.

According to another embodiment, instead of introducing warp web 20 from below, a number of pressing threads (not shown) for pressing the weft webs 15 on warp web 3, circulating between guide roller 22 and a drying means (not shown), are provided for holding temporarily weft webs between warp web 3 and said pressing threads, and when fixing of the warp and weft structure is almost finished, said pressing threads are peeled off from warp web 3 and returned towards guide roller 22, to obtain a product different from that explained above, i.e. a product consisting of a warp web cross-laminated with weft webs on one side surface thereof.

In another case where the warp material is a belt means composed of a number of belts 5 circulating in parallel, in place of a warp web employed as a warp material as explained above, the warp web is not guided as shown in FIG. 1*a*, but introduced through guide roller 22, as warp web 20, from below as shown in FIG. 1*c*, and onto said warp web 20, a row of weft webs 15 adhered onto the lower side of the belts one by one in the same way as explained above, is transferred by means of a number of peeling-off threads 31 which may be a part of yarns divided from warp web 20 or may be a circulating thread means guided between or adhered to each of said belts, respectively, so that said weft webs may be sandwiched between warp web 20 and peeling-off threads 31 and the whole is guided forwards for fixing the warp and weft structure thereof.

In case where both warp and weft webs are composed of a number of parallel yarns for producing a lattice-like structure, threads 31 should be guided through comb 32, while warp web 20 should be guided through comb 33 as shown in FIG. 1*c*, for determining the position of each yarn of the webs. Otherwise, for example, if threads are guided along the belts while being adhered onto the lower side thereof, it is difficult to produce a product of regularly ordered warp and weft structure.

In case where a warp web having a more or less laterally connected structure is used, the web should be guided from below, as explained above, and it is necessary to use independently separate yarns for peeling the weft webs off the belt means.

Further, in case where a hot melt type adhesive blend is used as a liquid having adhesion property, it is preferable to use steam-heated drums or cylinders for rollers 4 and 4', for the above-mentioned reason.

In case where weft webs glued in advance by a hot melt adhesive filaments are fed onto lattice conveyer 14, while keeping the surface having said adhesive filaments upwards, and said hot melt type adhesive blend is used at the same time, as a liquid having adhesion property, while keeping the belts hot, a small amount of said adhesive blend is retained on the belt surfaces when said belts are pushed downwards and pulled upwards in the cross-overlaying procedure as explained above. Accordingly, there is no need of employing a way in which a liquid having adhesion property is applied as shown in FIG. 1*a*.

Since hot melt type adhesive rapidly cools and solidifies, it is convenient for fixing the arrangement of webs after cross-lamination. This adhesive, however, is poor in the heat-resistance. Thus, in case where a heat-resistant adhesive is required, polyvinyl alcohol is often employed.

Generally, preliminarily glued webs are employed, and at the time of overlaying, a solution of high molecular weight polyethylene oxide in water is used as a liquid having adhesion property, and fixation of the warp and weft structure thus formed is effected by, say, heating after passing through pinching roller means 2, 2' at the outlet, and another procedure in which said webs are not glued in advance, but freshly glued at said pinching means for fixation of the structure followed by drying are preferable, since contamination of the cross-overlaying portion of the apparatus can be avoided.

Hereinunder, the present invention will be further illustrated in more detail with reference to the following examples which are in no ways intended to limit the scope of the present invention.

EXAMPLE 1

Using an apparatus as shown in FIG. 1*a*, 150 ends of flat yarns of 1,000 denier in thickness, made of high density polyethylene, were arranged in parallel at a rate of 3 ends per 25 mm into a web of 1,250 mm in width, guided as a web for wefts through a pinching roller means onto a wetted lattice conveyer, cut to a length of 1,250 mm one by one by a melt cutter on said conveyer and conveyed as cut weft webs while adhering onto the surface of the conveyer.

Separately, another web composed of 150 ends of flat yarns of the same sort were arranged in parallel in a width of 1,250 mm in the same manner as that of the web for wefts and then glued on the lower surface thereof with a hot melt type adhesive blend of ethylene-vinylacetate copolymer type in an amount of 7 gr. per square meter by kiss roller and cooled. The resulting web was guided to pinch roller means 1, 1', as shown in FIG. 1*a*.

Thereafter the web and belts 5 which were circulating while adhering to both of the back-side selvedges of the web, respectively, were wetted together with 0.02% aqueous solution of high molecular weight polyethylene oxide as a liquid having adhesion property by kiss roller 12, and the resulting web was guided as a warp web over the cut weft webs adhered onto the conveyer.

The warp web was subjected to pressing from the back-side thereof reciprocatingly by pressing rollers 18, 18' at a rate of 30 cycles per minute to pick up one cut weft web per each of said cycles and overlay it onto the warp web, while regulating the travelling speed of the warp web so that the cut weft webs might be picked up without leaving any gaps or overlapping parts between two of the successive cut weft webs temporarily adhered to the warp web.

After peeling off the belts on the selvedges, the warp web together with the row of cut weft webs overlaid thereon were caused to travel while holding the row of cut weft webs between said warp web and circulating pressing threads supplied from below at roller 22, and the whole was guided to pinching roller means 2, 2', where the whole was squeezed to remove contained liquid and guided to drying heated drums to fix the arrangement of warp and weft structure.

When the resulting product was almost dried up, said pressing threads were peeled off from the product and returned to roller 22 for circulation.

After completely dried up, a cross-laminated product of warp and weft yarns having no fear of becoming disordered yarn arrangement was finally obtained.

The product was suitable for reinforcing packaging paper obtained by lamination through an extrusion lamination method.

EXAMPLE 2

From four rolls of split fiber web of reticulated structure prepared by splitting a wide uniaxially stretched film of 620 mm in width and 20 micron in thickness, four webs were drawn out in the form of double row of double layer webs through pinching roller means at a speed of 36 meter per minute and just thereafter slitted into split fiber yarns of 20 mm in width.

After making slender under a tension, the yarns were guided in parallel at 10 mm pitches to form a web of 1,200 mm in width by a guide comb, and the resulting web was subjected to gluing with a hot melt type adhesive blend based on ethylene-vinylacetate copolymer in an amount of 10 gr. per square meter by means of a kiss roller, the cross-section of which was of a shape having projected parts on the periphery thereof and which was rotated half immersingly in said molten blend, while arranging said split fiber yarns of the web in parallel and evenly thin by passing zig-zag course over bars, and used as a web for each of the warp and weft webs.

Using a similar apparatus to that shown in FIG. 1*a*, six rubber belts with cord fabric therein, each having a width of 50 mm and a thickness of 2 mm were arranged at 250 mm pitches and circulated horizontally.

Along the lower circulating route of the belts, a half number of said yarns taken out as they were at every second from the original warp web, were caused to travel while being adhered onto the belts and wetted with 0.05% aqueous solution of high molecular weight polyethylene oxide as a liquid having adhesion property by kiss roller 12 and guided over the lattice conveyer on which cut weft webs of 1,200 mm in both length and width were loaded to be conveyed while leaving definite spacings between each of the webs.

The cut weft webs were picked up by said half of warp web together with backing up belts on the backside thereof at a rate of 30 times per minute to form a row of cut weft webs continuously arranged on said web composed of a half number of the yarns with backing up belts, and the resulting laminate of cut weft webs and warp web was peeled off from said belts and held between said web and the rest half of the original warp web so that the original arrangement might be recovered, according to the method as shown in FIG. 1*c*, and the whole was inroduced via pinching rollers 2, 2' over heated drums for fixing the warp and weft structure of the resulting product by the hot melt type adhesive polymer blend applied in advance, after drying up the wetting liquid contained therein.

The product had a fiber density of 70 g and 20 g of adhesive blend per square meter, respectively, a tenacity of 80 Kg per 5 cm in width and an elongation of 15 - 20%. The product, when thinly laminated with low density polyethylene, was suitable for raw cloth for heavy duty bags for packaging crops, etc.

Concerning the above mentioned Example, a modified procedure was tried as mentioned below.

Each of the split fiber yarns obtained by slitting the wide split fiber web into yarns of 20 mm width as above-mentioned, was made to have a width of about 5 mm after passing the comb of 10 mm pitches so that the width of the yarns might not be extended so much, and processed as mentioned above, for use as raw webs for cross-lamination and the thus processed webs were cross-laminated according to a method similar to that mentioned above. The product thus obtained was a cross-laminated product having thick warp and weft parts encircling thin portions.

When the product was laminated with low density polyethylene on both the surfaces thereof by extrusion method, the resulting product was a product difficult in cleaving along layers contained therein, having a high tear strength and suitable for use in outdoor covering sheets, etc., since the portions of polyethylene layers permeated through thin portions of the cross-laminated product from both the surfaces were fused together although the portions of polyethylene at thick warp and weft parts were permeated incompletely.

EXAMPLE 3

According to the method of the above-mentioned Japanese patent publication No. 9067/1976, published on Mar. 23, 1976, 250 ends of glass fiber yarns of 600 denier arranged in parallel in a width of 1,000 mm were fixed the parallel arrangement thereof by a number of laterally adhering 150 denier filaments of a hot melt type adhesive polymer blend based on ethylene-vinylacetate copolymer onto one surface thereof, and once wound up into a roll. The web thus prepared was used as a raw web for wefts.

The raw web for wefts drawn out from said roll through a pinching roller means where the web was wetted with water, was fed onto a lattice conveyer of the apparatus as shown in FIGS. 1*a* and 1*b*, while keeping the surface having said adhered adhesive filaments upwards.

The overall circulating length of the conveyer was divided into five sections, each having a length of 1,100 mm on each of which sections cut weft webs of 1,000 mm in length were to be loaded and conveyed one by one.

Another group of 250 glass fiber yarns of 600 denier was directly drawn out from bobbins on creels and warped as a warp web of 1,000 mm in width, and after passing through pinching means 1, 1', the web was divided into two webs, each consisting of 125 yarns taken out at every second from the web while keeping the width thereof intact.

One of thus divided webs was caused to travel over the lattice conveyer and the other below the conveyer. The two of said divided webs were joined and held the row of continuously arranged cut weft webs 15 picked up on belt means 5 and peeled off therefrom, between the two at guides 9 and 22, as shown in FIG. 1*c*.

Belt means 5 for picking up cut weft webs was composed of 6 rubber belts of 2 mm in thickness and 30 mm in width with cord fabric therein, two of which belts were provided on the respective selvedges of the warp web, and the rest 4 of which belts were positioned on the middle parts of the web and the belt means was caused to circulate along the route around roller 4 and 4'. On the lower circulating route of the belts, the belts were guided divergently and symmetrically by guide comb 6 so that the distance between the belts might be extended horizontally by 5 - 6 mm wider at the end of both the selvedge routes thereof, while, on the upper circulating route, the belts were guided convergently by guide comb 7 positioned near to the inlet side of roller 4 so that the original distance therebetween might be recovered.

Picking up cycle of cut weft webs on the belt means was 30 cycles per minute. Cut weft web adhered temporarily but firmly onto the belt means when picked up by the adhering force of 0.1% aqueous solution of high molecular weight polyethylene oxide as a liquid wetting the belt and having adhesion property were peeled off, held between said two divided warp webs from the upper and lower sides at rollers 9 and 22, squeezed to drive out the contained liquid at pinching roller means 2, 2' and sent to heated drums in order to dry up said liquid and melt the filaments of said adhesive blend adhered in advance onto the cut weft webs to extend the resulting melt of the filaments over the surface of the drums and among the warp and weft yarns.

The molten filaments of said adhesive blend on the surface of the heated drums were evenly distributed by touching rollers so that the melt might be extended also onto the yarns of the warp web which had not been applied with any of said adhesive blend in advance.

The whole was pressed during the course of cooling step to obtain a cross-laminated product composed of yarns of warp and weft structure of 4 mm pitches, whose crossing points were firmly bonded together. The product had 35 gr. of glass fiber yarns and 6.5 gr. of hot melt type adhesive blend per square meter thereof, respectively.

EXAMPLE 4

400 ends of glass fiber robings of 6,500 denier were arranged in parallel at 2.5 mm pitches into a web of 1,000 mm in width, wetted with water by spraying and guided onto a lattice conveyer also wetted with water. While being carried on said conveyor, the web was cut at every 1,000 mm in length into cut weft webs one by one inserting the web between a rotating cutting edge and a rubber plate provided on said conveyer.

Employing an apparatus similar to that shown in FIGS. 1*a* and 1*b*, 11 belts containing cord fabric therein and having a width of 50 mm were provided at 100 mm pitches and circulated, and along the lower side thereof, glass fiber yarns of 600 denier were guided at 25 mm pitches.

In a manner as shown in FIG. 1*a*, the cut weft webs on said lattice conveyer were picked up by said belts with said glass fiber yarns thereon, both wetted in advance with 0.1% aqueous solution of high molecular weight polyethylene oxide, at a rate of 30 times per minute, and at guide roller 22, the row of continuously arranged picked up cut weft webs was peeled off from the belt by using said 600 denier glass fiber yarns, which had been guided together with the belts on the lower circulation route thereof, onto the warp web composed of glass fiber robings of the same sort and fiber density as those of the web for wefts in such a manner that said row of weft webs was sandwiched between said warp web and glass fiber yarns. The whole was guided onto heated drums via pinching roller means for drying.

The intermediate product thus obtained was a cross-overlaid cloth-like one having the same fiber density on both the warp and weft layers, and the fiber density of the whole was 600 gr. per square meter.

Similarly to the above-mentioned Example, in case where robings finished in advance with a silane coupling agent are used, the intermediate product thus obtained is directly impregnated just after dried with a liquid resin suitable for producing F.R.P., while being inserted between polyethylene film for releasing purpose, and wound up for use for a molding process, after advancing the polymerization degree of the resin in a state still keeping the thermoplastic nature thereof. The final fixing of the warp and weft structure is secured in said molding process.

In case where as warp webs for holding weft webs therebetween, webs composed of glass fiber yarns of 600 denier alone arranged in parallel at 25 mm pitches are used for upper and lower side webs, a product suitable for reinforcing mainly in the lateral direction is obtained.

Further, there is a case where a product of the present invention is used as a substrate for laminating while being impregnated with a molten thermoplastic polymer. As the substrate for said purpose, a product made of nylon fibers, polyester fibers or other organic fibers are preferable and widely used and it is preferable to use webs which have been glued with a hot melt type adhesive blend, or glued additionally with a polymer of PVA group or others which is heat-resistant, after cross-lamination.

What is claimed is:

1. In the method for forming a crosswise structure of wide warp and weft webs without leaving any gaps between each of the weft webs in the production of a cross-laminated cloth-like product, where a warp web is continuously fed to travel in the warp direction of the product to be prepared and weft webs cut to a length corresponding to the width of the product to be prepared, are fed horizontally one by one along the line crosswise to that of production of the product and after cross-overlaid, the resulting structure of warp and wefts is fixed by a binder, an improved method for temporarily forming a continuous row of cut weft webs arranged in side by side relationship before fixing said warp and weft structure, which comprises:

causing a warp material to travel horizontally along the line of production of product, while intersecting the feeding line of cut weft webs carried on a conveyer and travelling horizontally and crosswise thereto and vertically apart therefrom, said warp material being wetted on the surface thereof to be opposed to the cut weft webs, with a liquid having adhesion property, and having a sufficient width for covering the width of the warp web and a sufficient effective surface area for picking up the whole of one of the cut weft webs in the flat state, when wetted with said liquid;

at each time when one of the cut weft webs comes to the position wholly overlapped with the travelling warp material, subjecting at least the part of the warp material facing the one of the cut weft webs to a sudden reciprocating vertical motion so as to touch and pick up the cut weft web by temporary adhesion to the warp material due to the action of said liquid having adhesion property; and repeating the above-mentioned reciprocating motions of the warp material successively, whenever the warp material advances by the distance corresponding to the width of the cut weft web at a speed so controlled that the cut weft webs are picked up one by one in a row without leaving any gaps between each other, and thereby effecting temporary forming of a continuous row of cut weft webs arranged in side by side relationship on the warp material.

2. A method according to claim 1 wherein the warp material is a belt means from which the temporarily formed continuous row of cut weft webs is transferred onto the warp web so as to be overlaid thereon.

3. A method according to claim 1 wherein the warp material is a warp web backed up with a belt means, from which belt means the warp web with temporarily formed continuous row of cut weft webs overlaid thereon, is peeled off.

4. A method according to claim 1 wherein the warp material is a warp web alone, on which the temporarily formed continuous row of cut weft webs is to be overlaid.

* * * * *